United States Patent [19]

Mizukado et al.

[11] Patent Number: 4,640,166

[45] Date of Patent: Feb. 3, 1987

[54] TURRET PUNCH PRESS

[75] Inventors: Masayoshi Mizukado, Kani; Akio Morishita, Inuyama; Yoshihiro Muto, Mino, all of Japan

[73] Assignee: Yamazaki Machinery Works, Ltd., Aichi, Japan

[21] Appl. No.: 792,022

[22] Filed: Oct. 28, 1985

[30] Foreign Application Priority Data

Oct. 29, 1984 [JP] Japan ..... 59-227517

[51] Int. Cl.[4] ..... B21D 28/36; B26D 5/06

[52] U.S. Cl. ..... 83/552; 83/71; 83/559; 83/640

[58] Field of Search ..... 83/552, 559, 71, 618, 83/640; 72/23, 442

[56] References Cited

U.S. PATENT DOCUMENTS 4,343,210 8/1982 Kuroyone ..... 83/552
4,412,469 11/1983 Hirata et al. ..... 83/552
4,532,845 8/1985 Jinnouchi ..... 83/552

FOREIGN PATENT DOCUMENTS 0019839 1/1969 Japan ..... 83/559
141337 11/1980 Japan ..... 83/559

*Primary Examiner*—Donald R. Schran
*Attorney, Agent, or Firm*—Cushman, Darby & Cushman

[57] ABSTRACT

A first drive means is provided to an upper turret and a lower turret in such a manner as that the upper turret and lower turret can be synchronously rotated through a turret drive system, and a second drive means is provided to an upper metallic mold and a lower metallic mold in such a manner as that the upper and the lower metallic molds can be synchronously rotated within the respective turrets through a metallic mold drive system, and the metallic mold drive system is connected to the turret drive system through a differential gear mechanism. And, when the turrets are positioned, the second drive means is held stopped and the metallic molds each holding its own dividing angle are rotated within the respective turrets by the first drive means through the differential gear mechanism. The dividing of the angles for the respective metallic molds is carried out through the differential gear mechanism by the second drive means while maintaining the turrets positioned and stopped.

3 Claims, 3 Drawing Figures

TURRET PUNCH PRESS

BACKGROUND OF THE INVENTION

This invention relates to a turret punch press having a rotatable metallic mold in a turret.

When a rotatable metallic mold is held in a rotating turret and the metallic mold is rotated according to necessity of machining, various kinds of holes can be machined by one metallic mold.

Heretofore, there has been well known as a method for rotating a metallic mold in a turret a method for connecting a metallic mold within a turret with means for rotating a metallic mold disposed outside of the turret by using a clutch as proposed in Japanese Laid-open Patent Publication No. 58-53333.

However, in this conventional method, the construction of a punch press becomes complicated to the extent of a provision of the clutch mechanism. In addition, there requires a longer waste of time to the extent of time required for intermittent action of the clutch mechanism. Accordingly, it has such a shortcoming as that the number of striking is decreased per unit time. Moreover, a metallic mold which is not connected to a clutch is readily rotated within a turret. Accordingly, there requires some kind of a brake mechanism, which again makes the construction of the turret complicated.

SUMMARY OF THE INVENTION

It is therefore a primary object of the present invention to provide a turret punch press, wherein a cluch mechanism is no more required in order to eliminate the foregoing disadvantages, and therefore, construction thereof is simple, and number of strikings can be increased per unit time.

It is a second object of the present invention to provide a turret punch press, wherein a metallic mold can maintain its dividing angular position within a turret without provision of a brake mechanism.

That is, the present invention comprises a first drive means provided to an upper turret and a lower turret in such a manner as that the upper turret and lower turret can be synchronously rotated through a turret drive system, a second drive means provided to an upper metallic mold and a lower metallic mold in such a manner as that the upper and the lower metallic molds can be synchronously rotated within the respective turrets through a metallic mold drive system, the metallic mold drive system being connected to the turret drive system through a differential gear mechanism, change gear ratios of both the drive systems and the differential gear mechanism being set as such that the metallic molds can be driven by the first drive means within the respective rotatable turrets without changing a dividing angular position thereof while the second drive means being held stopped.

Due to the above-mentioned constitution, the present invention functions as follow. When the turrets are positioned, the metallic molds are driven to rotate within the respective turrets by the first drive means through the differential gear mechanism by holding the second drive means stopped, while maintaining their own dividing angles. The dividing of angles of the respective metallic molds is effected by rotating the second drive means through the differential gear mechanism, with the turrets positioned and stopped.

DESCRIPTION OF THE PREFERRED EMBODIMENT

A preferred embodiment of the present invention will be described hereunder with reference to the accompanying drawings.

Figure 2:
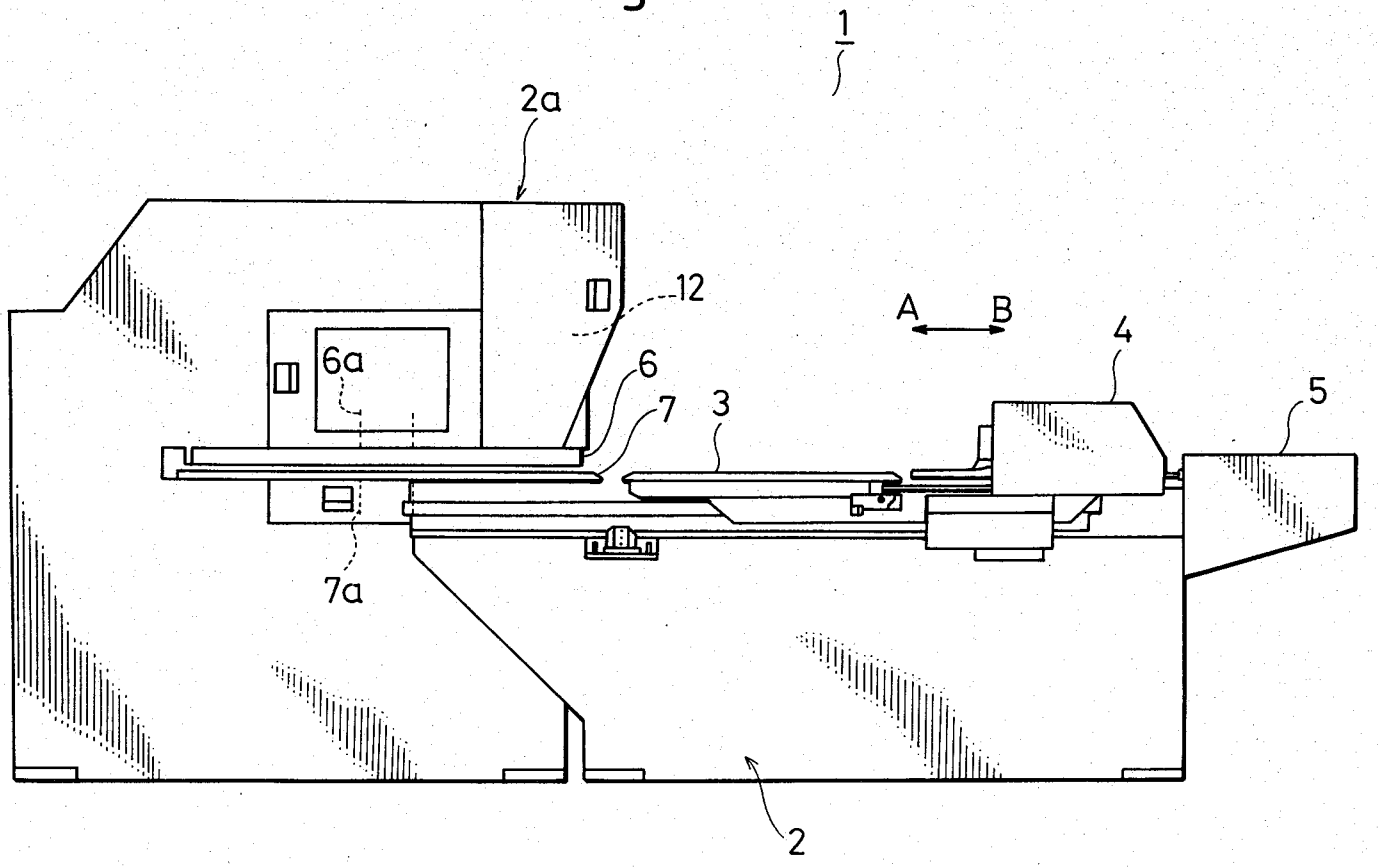
FIG. 2 is a front view showing one example of a turret punch press to which the present invention is applied.

A turret punch press 1 has a machine body 2 as shown in FIG. 2. Disposed at the right portion of the machine body 2 in the figure is a table 3. Further, disposed at the right portion of the table 3 of the machine body 2 is a positioning apparatus 4 adapted to position a workpiece with respect to its vertical direction to a paper surface. Disposed at a further right portion of the positioning apparatus 4 and on the machine body 2 is another positioning apparatus 5 adapted to position a workpiece with respect to the directions as shown by two headed arrows A and B. At a left part of the machine body 2, an upper machine body **2*a* is formed in such a manner as to hang thereover. The upper machine body 2*a* is rotatably provided through a shaft 6*a* with an upper turret 6 formed in a disc shape. Further, at a location opposite to the upper turret 6 of the machine body 2, there is rotatably provided through a shaft 7*a* with a lower turret 7** formed in a disc shape.

Figure 1:
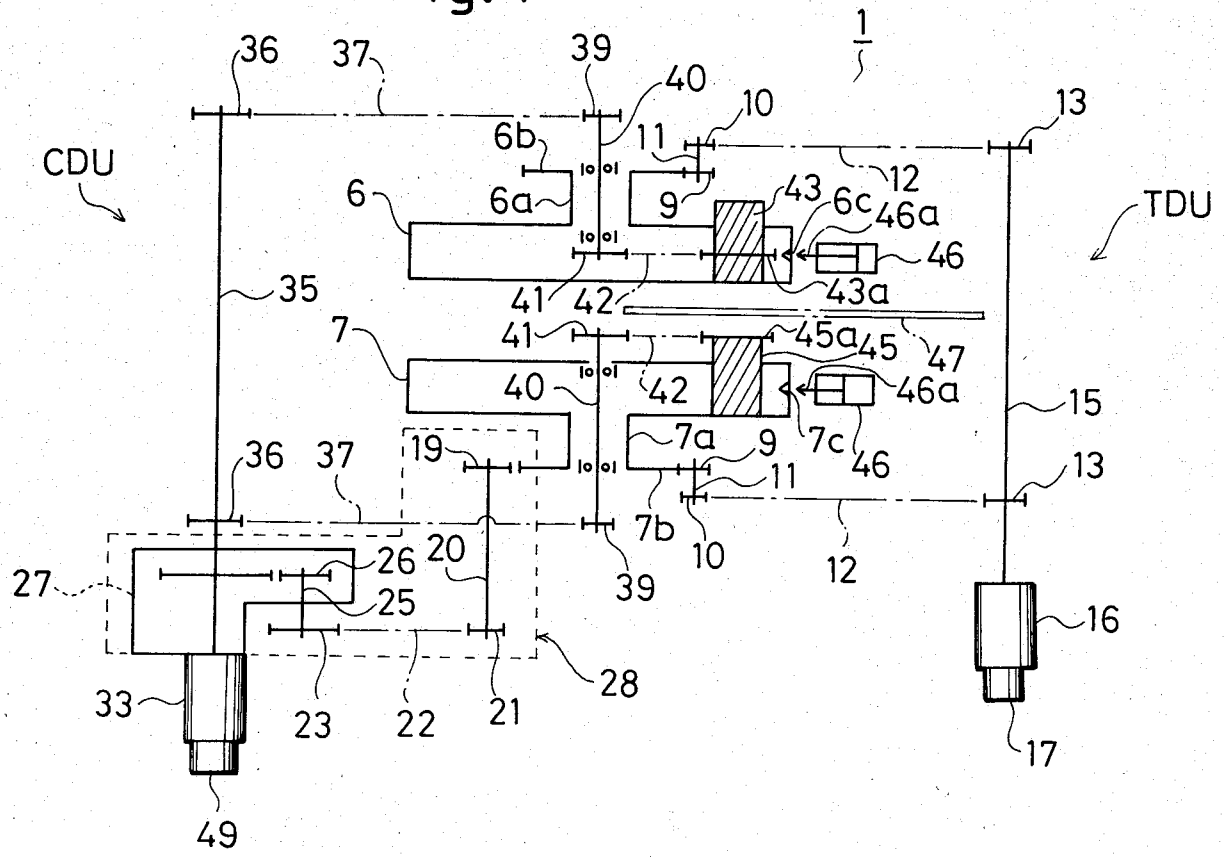
FIG. 1 is a drive system diagram showing one example of drive system of turrets and metallic molds of a turret punch press according to the present invention.

Furthermore, the shafts **6*a* and 7*a* of the upper and lower turrets 6 and 7 are formed with driving gears 6*b* and 7*b* respectively, as shown in FIG. 1. The respective driving gears 6*b* and 7*b* are meshed with gears 9, 9 which constitute a turret drive system TDU. The gears 9, 9 are provided with sprockets 10, 10 through shafts 11, 11. Connected to the sprockets 10, 10 are sprockets 13, 13 mounted on a shaft 15 through chains 12, 12 serving as power transmission means. The shaft 15 is connected to a drive motor 16. Disposed on the drive motor 16 is a transducer 17 adapted to detect rotation angle of the drive motor 16**.

Figure 3:
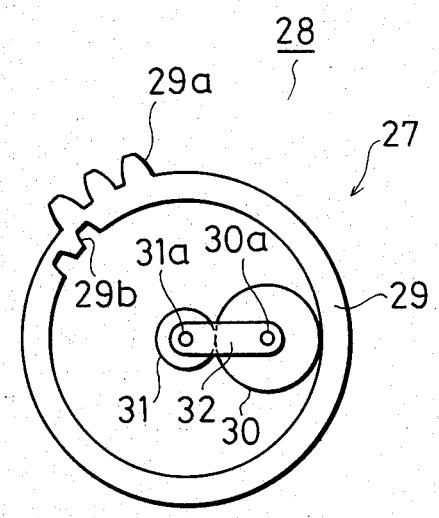
FIG. 3 is a plan view showing one example of a planetary gear apparatus.

On the other hand, the driving gear **7*b* is meshed with a gear 19 which constitutes a differential gear mechanism 28. The gear 19 is provided with a sprocket 21 through a shaft 20. The sprocket 21 is provided with a sprocket 23 through a chain 22. Meshed with the sprocket 23 through a shaft 25 is a gear 26 which is connected to a planetary gear apparatus 27. The planetary gear apparatus 27 rotatably supports an outer gear 29*a* meshed with the gear 26, as shown in FIG. 3. The outer gear 29*a* is formed on a member 29, and at an internal side of the member 29, an inner gear 29*b* is formed. That is, the outer gear 29*a* and the inner gear 29*b* are formed as a same member 29.) The inner gear 29*b* is meshed with a sun gear 31 through a planetary gear 30. Between the planetary gear 30 and the sun gear 31, an arm 32 is disposed in such a manner as to be relatively rotatable through shafts 30*a* and 31*a*. Connected to the sun gear 31 is a drive motor 33 with a braking function built therein, as shown in FIG. 1. Connected to the arm 32 is a shaft 35 which constitutes a metallic mold drive system CDU. The shaft 35 is mounted with sprockets 36, 36. Connected to the sprockets 36, 36 through chains 37, 37 are sprockets 39, 39. The sprockets 39, 39 are mounted on shafts 40, 40 which are rotatably supported within the shafts 6***a* and 7*a*. The shafts 40, 40 are mounted with sprockets 41, 41. Connected to the sprockets 41, 41 are sprockets 43*a* and 45*a* mounted on an upper metallic mold 34 and a lower metallic mold 45 through chains 42, 42. The upper and lower metallic molds 43 and 45 are rotatably supported with respect to the respective upper and lower turrets 6 and 7. At outer peripheral portions of the respective upper and lower turrets 6 and 7, position holes 6*c* and 7*c* are defined. Further, at locations opposite to the position holes 6*c* and 7*c*, stopper pins 46, 46 are disposed in such a manner as to projectably drive pins 46*a*, 46*a*.

With the above-mentioned constitution of the turret punch press 1, when a workpiece is machined by utilizing the turret punch press 1, a workpiece 47 is put on the table 3, and the positioning apparatuses 4 and 5 are driven to move the workpiece 47 in the directions as shown by two headed arrows A and B, and the directions perpendicular thereto so as to bring the workpiece 47 in a predetermined position for striking. Simultaneously, the turrerts 6 and 7 are rotated to divide the metallic molds 43 and 45 in predetermined striking positions. Furthermore, after the metallic molds 43 and 45 are divided in predetermined machining angles, the workpiece 47 is punched. This operation is performed as follows. Firstly, as shown in FIG. 1, the brake function of the drive motor 33 is actuated to hold the rotation of the sun gear 31 restricted. Then the drive motor 16 is driven for rotation. The rotation of the drive motor 16 causes the sprockets 13, 13 to rotate through the shaft 15. It further rotates the chains 12, 12, and sprockets 10, 10. It still further rotates the shafts 11, 11 together with the gears 9, 9. As a result, the upper and lower turrets 6 and 7 are synchronically rotated about the shafts 6*a* and 7*a* through the drive gears 6*b* and 7*b* by same angles in the same direction [gear ration (change gear ratio)] of sprockets 13 and 10, and gear 9 and drive gears 6*b* and 7*b* is such that the upper turret 6 and the lower turret 7 are permitted to synchronically rotated) to bring metallic molds to be used for machining, i.e., the upper metallic mold 43 and the lower metallic mold 45, to the predetermined striking positions. When the upper and lower metallic molds 43 and 45 are positioned in the predetermined striking positions, the pin 46*a* of each of the stopper pins 46, 46 is caused to project toward the turret to insert the pin 6*a* into the position holes 6*c* and 7*c*. As a result, the upper and lower turrets 6 and 7 are restricted to rotate about the shafts 6*a* and 7*a* due to the insertion of the pin 46*a* into the position holes 6*c* and 7*c*, and firmly secured with respect to the machine body 2. The rotation angle of the drive motor 16 is detected and controlled by the transducer 17. Accordingly, the respective turrets 6 and 7 can be smoothly positioned in the predetermined positions by controlling the rotation angle of the drive motor 16.

When the drive motor 16 is rotated to cause the lower turret 7 to rotate, the sprocket 21 is rotated through the drive gear 7*b*, the gear 19 and the shaft 20. Further, the outer gear 29*a* of the planetary gear apparatus 27 is rotated together with the inner gear 29*b* through the chain 22, the sprockets 23, the shaft 25, and the gear 26. However, since the drive motor 33 is restricted its rotation, the sun gear 31 is connected to the drive motor 33 is also restricted its rotation and stopped. Accordingly, when the inner gear 29*b* is rotated together with the rotation of the outer gear 29, the planetary gear 30 rotates around the sun gear 31 which stopped rotation, and the arm 32 is also rotated together with the rotation of the planetary gear 30 (at this time, the directions of rotation of the planetary gear 30 and the arm 32 are same as the direction of rotation of the inner gear 29*b*). Since the arm 32 is connected with the shaft 35, the shaft 35 is rotated in synchronism with the rotation of the arm 32 to cause the sprockets 43*a* and 45*a* of the upper and lower metallic molds 43 and 45 to rotate through the sprocket 36, the chain 37, and the sprocket 39, and further through the shaft 40, the sprocket 41, and the chain 42. At this time, due to the gear ratio, i.e. the change gear ratio, of the drive system from the gear 19 to the sprockets 43*a* and 45*a*, and the gears and sprockets of the differential gear mechanism, the upper and the lower metallic molds 43 and 45 are synchronously rotated within the respective upper and lower turrets 6 and 7. Regarding the number of rotation thereof, while the respective turrets 6 and 7 are rotated about the shafts 6*a* and 7*a* by 360°, the respective metallic molds 43 and 45 are also rotated by 360° in the same direction of the turrets 6 and 7 within the turrets 6 and 7. That is, when the turrets 6 and 7 are looked from outside, the respective metallic molds 43 and 45 are rotated in a manner as if they were stopped. This means that the respective metallic molds 43 and 45 always maintain a constant dividing angle with respect to the workpiece 47 put on the table 3 disposed outside of the turret.

In this way, when the positioning of the respective turrets 6 and 7 is completed, the respective turrets 6 and 7 are held stopped by a stopper pin 46 to perform the positioning of the upper and the lower metallic molds 43 and 45. Then, the drive motor 33 is released from its being held stopped and rotated by a predetermined angle of rotation. When the drive motor 33 is rotated, the arm 32 is also rotated through the sun gear 31 and the planetary gear 30, and the shaft 35 is also rotated. However, the inner and the outer gears 29*b* and 29*a* are not rotated, since the lower turret 7 is restricted its rotation by the stopper pin 46 to cause the inner and the outer gears 29*b* and 29*a* to be held and stopped (at this time, the direction of rotation of the arm 32 is same as the direction of rotation of the sun gear 31, and the direction of rotation of the planetary gear 30 is the other way of the direction of rotation of the sun gear 31). In this way, the shaft 35 is rotated due to the rotation of the sun gear 31, and the respective metallic molds 43 and 45 are synchronously rotated by predetermined angles as in the same manner as described. Since the angles of rotation of the respective metallic molds 43 and 45 are detected and controlled by a transducer 49 connected to the drive motor 33, the dividing operation of predetermined machining angle of the respective metallic molds 43 and 45 is correctly carried out by controlling the angle of rotation of the drive motor 33. As already described, since the outer gears 29*a* and the inner gears 29*b* are not rotated, the angles of rotation of the respective metallic molds 43 and 45 are subjected to the angle of rotation of the drive motor 45. Thus, the angle dividing of the respective metallic molds 43 and 45 is carried out smoothly (as a matter of course, the change gear ratio of the metallic drive system CDU is set so as to permit the metallic molds 43 and 45 to rotate synchronously).

Even if the turrets 6 and 7 are rotated after the angles of the metallic molds 43 and 45 are divided, since the respective metallic molds 43 and 45 are held stopped within the turrets 6 and 7 with respect to outside as long as the drive motor 33 is held stopped and the sun gear 31 is held stopped during the rotation of the turrets 6 and 7, the dividing angle by the drive motor 33 can be maintained, and will not get out of order due to rotation of the turrets 6 and 7.

In this way, at the time when the upper and the lower metallic molds 43 and 45 are positioned within the respective turrets 6 and 7, a striker (not shown) is actuated to cause the upper metallic mold 43 to strike the lower metallic mold 45 in order to punch the workpiece 47 held between the upper and the lower metallic molds 43 and 45.

When the machining by the metallic molds 43 and 45 is finished, the upper and the lower turret 6 and 7 are rotated by the drive motor 16 to position metallic molds to be used for the next punching process in a predetermined striking position, and the machining is continued in the same way as described. At the same time when the turrets 6 and 7 are rotated, since the the drive motor 33 for positioning the metallic molds are held stopped, the metallic molds 43 and 45 with the predetermined angles divided within the turrets 6 and 7 are held with the dividing angles. Accordingly, at the time when metallic molds 43 and 45 are positioned in the striking positions for the next machining, these metallic molds are no more required to effect positioning, and positioned in the predetermined dividing angle position which was already divided. At this time, when a required is such that the metallic molds 43 and 45 are used with different dividing angles, the metallic molds can be positioned in correct positions merely by controlling the rotation of the metallic molds by the drive motor 33 based on the present dividing angles of the metallic molds 43 and 45 after the turrets 6 and 7 are held stationary.

In the above embodiment, the planetary gear apparatus 27 is used for the differential gear mechanism 28 adapted to connect the turret drive system TDU with the metallic mold drive system CDU. However, the differential gear mechanism 28 is not limited to the planetary gear apparatus 27. Alternatively, it may be formed of a combination of bevel gears.

As described in the foregoing, a turret punch press according to the present invention comprises a first drive means such as drive motor 16 provided to upper turret 6 and lower turret 7 in such a manner as that the upper and lower turrets 6 and 7 can be synchronously rotated through turret drive system TDU such as gear 9, chain 12, sprockets 10 and 13, a second drive means such as drive motor 33 provided to upper metallic mold 43 and lower metallic mold 45 in such a manner as that the upper and the lower metallic molds 43 and 45 can be synchronously rotated within the respective turrets 6 and 7 through a metallic mold drive system CDU such as sprockets 36, 39, 41, 43*a*, and 45*a*, and chain 37 and 42, the metallic mold drive system CDU being connected to the turret drive system TDU through a differential gear mechanism 28, change gear ratios of both the drive systems and the differential gear mechanism 28 being set as such that the metallic molds 43 and 45 can be driven by the first drive means within the respective rotatable turrets 6 and 7 without changing a dividing angular position thereof while the second drive means being held stopped. Accordingly, the respective metallic molds 43 and 45 within the respective turrets 6 and 9 are held within the turrets 6 and 9 with the angle divided by the second drive means remained as it is, and therefore, no additional device such as a special brake mechanism for holding the metallic molds with respect to the turrets is required. Thus, a simple structure of the turret can be obtained. Further, since the upper and lower metallic molds 43 and 45 within the upper and lower turrets 7 and 8 are always connected to the metallic mold drive system CDU, no clutch mechanism is required to provide to the drive system between the drive motor 33 and the metallic molds 43 and 45. Accordingly, the metallic molds 43 and 45 to be used for the machining can be immediately subjected to the positioning operation after the positioning thereof is effected by rotating the turrets 6 and 7. Accordingly, no nuisance intermittent operation of clutch is required at all. Thus, waste of time is lessened to that extent. As a result, the number of the striking per unit time can be increased. Moreover, the punch press 1 can be made more simple in its structure and smaller in its size to that extent.

Although the present invention has been described with reference to the preferred embodiment, the embodiment described herein is for illustrative purposes only and not in limitation thereof. Also, the scope of the present invention is defined in the appended claims and will not be binded by description of the embodiment. Accordingly, it will be understood that all changes and modifications which belong to the appended claims fall within the true spirit and scope of the present invention.

What is claimed is:

1. A turret punch press including a rotatably mounted upper turret and a rotatably mounted lower turret, said upper turret and said lower turret being provided with at least one upper tool and a at least one lower tool, respectively, said upper and lower tools being positioned in a predetermined striking position by rotating said turrets, said upper and lower tools being rotatably mounted and positioned within the respective turrets for performing a punching process while holding the tools in desired angular positions, comprising:

a first drive means for driving said upper turret and said lower turret in such a manner that said upper and lower turrets can be synchronously rotated through a turret drive system; and a second drive means for driving said upper tool and said lower tool in such a manner as that said upper and lower tools can be synchronously rotated within their respective turrets through a tool drive system;

said tool drive system being connected to said turret drive system through a differential gear mechanism, gear ratios of both the drive means and the differential gear mechanism being set as such that said tools can be driven by said first drive means within the respective rotatable turrets without changing angular position thereof while said second drive means is stopped.

2. A turret punch press according to claim 1, wherein said differential gear mechanism includes a planetary gear apparatus comprising a sun gear connected to said second drive means, an outer gear connected to said turret drive system, a planetary gear for connecting said sun gear with said outer gear, and an arm for connecting said sun gear with said planetary gear and connected to said tool drive system.

3. A turret punch press according to claim 1, wherein said second drive means comprises a motor having a brake function.

* * * * *